United States Patent [19]

Kato et al.

[11] Patent Number: 4,983,486

[45] Date of Patent: Jan. 8, 1991

[54] LIQUID DEVELOPERS FOR ELECTROPHOTOGRAPHY

[75] Inventors: Eiichi Kato; Kazuo Ishii, both of Shizuoka, Japan

[73] Assignee: Fuji Photo Film Co., Ltd., Kanagawa, Japan

[21] Appl. No.: 427,273

[22] Filed: Oct. 24, 1989

[30] Foreign Application Priority Data

Oct. 24, 1988 [JP] Japan ..... 63-266128

[51] Int. Cl.[5] ..... G03G 9/12

[52] U.S. Cl. ..... 430/115; 430/904

[58] Field of Search ..... 430/114, 115, 904

[56] References Cited

U.S. PATENT DOCUMENTS 3,900,412 8/1975 Kosel ..... 430/114

4,250,241 2/1981 Tsubuko et al. ..... 430/114

*Primary Examiner*—David Welsh

*Attorney, Agent, or Firm*—Sughrue, Mion, Zinn, Macpeak & Seas

[57] ABSTRACT

Disclosed is a liquid developer composition for electrophotography. In a non-aqueous solvent there is dispersed copolymer resin particles having been polymerized from at least one monofunctional monomer (A) and at least one monofunctional macromonomer (B) such as (III)

and (II)

in the presence of a dispersion stabilization resin copolymerizable with a mono-functional monomer (A).

5 Claims, No Drawings

LIQUID DEVELOPERS FOR ELECTROPHOTOGRAPHY

FIELD OF THE INVENTION

This invention relates to liquid developers for electrostatic photography wherein a resin at least is dispersed in a liquid carrier whose electrical resistance is $10^9$ Ω.cm or above and whose dielectric constant is not more than 3.5 and, more precisely, it relates to liquid developers which have excellent redispersion properties, storage properties, stability, image reproduction properties and fixing properties.

BACKGROUND OF THE INVENTION

In general, liquid developers for electrophotographic purposes are obtained by dispersion organic or inorganic pigments or dyes, such as carbon black, nigrosine or phthalocyanine blue, for example, and natural or synthetic resins, such as alkyd resins, acrylic resins, rosin or synthetic rubbers, for example, in a liquid which has good electrically insulating properties and a low dielectric constant, such as a petroleum based aliphatic hydrocarbon, and adding polarity controlling agents such as metal soaps, lecithin, linseed oil, higher fatty acids or polymers which contain vinylpyrrolidone, for example.

In developers of this type, the resin is dispersed in the form of insoluble latex particles with a particle diameter from a few nm to a few hundred nm. However, in a conventional liquid developer the bonding between the soluble resin, which is used for dispersion stabilization purposes, or the polarity controlling agent and the insoluble latex particles is insufficient, as a result, the soluble resin for dispersion stabilization purposes or the polarity controlling agent readily diffuses into the solvent. Consequently, the soluble resin for dispersion stabilization purposes becomes separated from the insoluble latex particles. On long term storage or repeated use, the particles may sediment, coagulate or lump together, and the polarity becomes indistinct. Furthermore, it is difficult to redisperse particles once they have been sedimented or formed into lumps, as a result they tend to become attached to certain parts of the developing apparatus and they may contaminate the image parts or cause a breakdown of the developing machine by blocking pumps, for example.

It has been suggested that the insoluble latex particles should be chemically bound to the soluble resin for dispersion stabilization purposes in an attempt to eliminate these disadvantages, and disclosures to this effect have been made, for example, in U.S. Pat. No. 3,990,980. However, although such liquid developers are somewhat better in terms of their dispersion stability with respect to the natural sedimentation of the particles, this effect is not sufficient. The redispersion stability still is insufficient. Moreover, when these developers are used in actual developing apparatus there is a problem in that the toner which becomes attached to various parts of the apparatus solidifies in a film like form from which redispersion is difficult. This can lead to a breakdown of the apparatus and contamination of the transferred images for example. Furthermore, the combinations of dispersion stabilizers and insolubilized monomers which can be used to prepare mono-disperse particles with a narrow particle size distribution is very limited in the methods of manufacture of resin particles disclosed in the above mentioned documents. They tend to be polydisperse particles which have a wide particle size distribution including large numbers of large, coarse particles or in which two or more average particle sizes are present. Furthermore, it is difficult to obtain particles of the prescribed average particle size in a mono-dispersion which has a narrow particle size distribution, and large particles of at least 1 μm, or very fine particles of less than 0.1 μm, are formed. Moreover, there is a further problem in that the dispersion stabilizers which are used must be prepared using a complicated and time consuming process.

Additionally, methods of overcoming the above mentioned problems in which the degree of dispersion of the particles, the redispersion properties and the storage properties are improved by using insoluble dispersed resin particles of copolymers of insolubilized monomers and monomers which contain long chain alkyl groups or monomers which contain two or more polar components were disclosed, for example, in JP-A-No. 60-179751 and JP-A-No. 62-151868. (The term "JP-A" as used herein signifies an "unexamined published Japanese patent application".)

On the other hand, techniques in which more than 5000 copies are printed using offset printing master plates obtained using electrophotographic techniques have been introduced in recent years. In particular, progress has been made in improving the master plates so that it is now possible to print in excess of 10,000 copies even with large plate sizes. Furthermore, progress has been made in shortening the operating time of the electrophotographic plate making system where improvements have been achieved in speeding up the development/fixing processes.

The dispersed resin particles manufactured using the procedures disclosed in the aforementioned JP-A-No. 60-179751 and JP-A-No. 62-151868 do not always provide satisfactory performance in terms of particle dispersion properties and redispersion properties when development speeds are increased and in terms of printing resistance when the fixing time is shortened or when the master plate is large (for example A3 size or greater).

The problems encountered with conventional liquid developers of the type described above are solved by the present invention.

SUMMARY OF THE INVENTION

An object of the present invention is to provide liquid developers which have excellent dispersion stability, redispersion properties and fixing properties even in electrophotographic printing plate making systems which involve high speed development and fixing and in which large size master plates are used.

Another object of the present invention is to provide liquid developers with which it is possible to form, by means of an electrophotographic process, offset printing original plates which have excellent printing ink receptivity and printing durability (press life).

A further object of the present invention is to provide liquid developers which, in addition to the applications aforementioned, are appropriate for use in various electrophotographic applications and various copying or printing applications.

An even further object of the present invention is to provide liquid developers which can be used in systems in which liquid developers can be used for ink jet recording and, cathode ray tube recording and for recordings made, for example, when changes in pressure occur or, when electrostatic variations occur.

The above mentioned objects of the invention are achieved by a liquid developer for an electrostatic photographic process in which a resin at least is dispersed in a non-aqueous solvent whose electrical resistance is at least $10^9$ Ω.cm and whose dielectric constant is not more than 3.5, where the dispersed resin particles are copolymer resin particles obtained by polymerization of a solution which contains at least one monofunctional monomer (A) which is soluble in a non-aqueous solvent but which is rendered insoluble by polymerization and at least one monofunctional macromonomer (B) whose number average molecular weight is not more than $10^4$ obtained by bonding a polymerizable double bond group represented by the general formula (III)

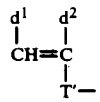

(III)

wherein T' has the same meaning as T; and $d^1$ and $d^2$, which may be the same or different, each has the same meaning as $b^1$ and $b^2$;

to only one end of the main chain of a polymer comprising repeating units represented by the general formula (II)

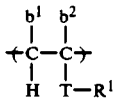

(II)

wherein T represents —COO—, —OCO—, —$CH_2$OCO—, —$CH_2$COO—,

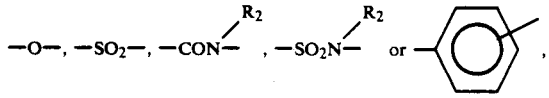

where $R_2$ represents a hydrogen atom or a hydrocarbyl group which has from 1 to 22 carbon atoms; $R_1$ represents a hydrocarbyl group which has from 1 to 22 carbon atoms; $b^1$ and $b^2$, which may be the same or different, each represents a hydrogen atom, a halogen atom, a cyano group, a hydrocarbyl group which has from 1 to 8 carbon atoms, a —COO—$R^3$ group or a —COO—$R^3$ group which is linked via a hydrocarbyl group which has from 1 to 18 carbon atoms;

with the polymerization being in the presence of a resin for dispersion stabilization purposes obtained by bonding a polymerizable double bond group which can be copolymerized with a mono-functional monomer (A) to just one end of the main chain of a polymer which has at least one repeating unit represented by the general formula (I)

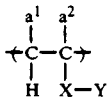

(I)

wherein X represents —COO—, —OCO—, —$CH_2$OCO—, —$CH_2$COO—, —O— or —$SO_2$—; Y represents an aliphatic group which has from 6 to 32 carbon atoms; $a^1$ and $a^2$, which may be the same or different, each represents a hydrogen atom, a halogen atom, a cyano group, a hydrocarbyl group which has from 1 to 8 carbon atoms, a —COO—$Z^1$ group or a —COO—$Z^1$ group which is linked via a hydrocarbyl group which has from 1 to 8 carbon atoms and where $Z^1$ represents a hydrocarbyl group which has from 1 to 22 carbon atoms.

DETAILED DESCRIPTION OF THE INVENTION

The liquid developers of this present invention are described in detail below.

The use of linear chain or branched chain aliphatic hydrocarbons, alicyclic hydrocarbons or aromatic hydrocarbons, and halogen substituted derivatives thereof, is preferred for the carrier liquid whose electrical resistance is at least $10^9$ Ω.cm and whose dielectric constant is not more than 3.5 which is used in the invention. For example, octane, iso-octane, decane, iso-decane, decalin, nonane, dodecane, iso-dodecane, cyclohexane, cyclo-octane, cyclodecane, benzene, toluene, xylene, mesitylene, Isoper E, Isoper G, Isoper H, Isoper L ("Isoper" is a trade name of the Exxon Co.), "Shellsol 70", "Shellsol 71" ("Shellsol" is a trade name of the Shell Oil Co.), "Amsco OMS", and "Amsco 460" solvent ("Amsco" is a trade name of the Spirits Co.) can be used individually or in the form of mixtures thereof.

The non-aqueous dispersion of resin particles (referred to hereinafter simply as "latex particles") which are a very important component in the present invention are prepared as polymer particles in a non-aqueous solvent by copolymerization (the so-called polymerization particle forming method) of the above-described monofunctional monomer (A) and monofunctional macromonomer (B) in the presence of the aforementioned resin for dispersion stabilization purposes which has a polymerizable double bond group which can copolymerize with the mono-functional monomer (A) only at one end of the main chain of a polymer which has at least one type of repeating unit represented by the general formula [I].

The non-aqueous solvent is basically any solvent which is miscible with the carrier liquid of the aforementioned liquid developer for electrostatic photography.

More specifically, the solvents which can be used when preparing the dispersed resin particles should be miscible with the aforementioned carrier liquids, and the use of linear chain or branched chain aliphatic hydrocarbons, alicyclic hydrocarbons, aromatic hydrocarbons and halogen substituted derivatives thereof is preferred. For example, solvents such as hexane, octane, iso-octane, decane, iso-decane, decalin, nonane, dodecane, iso-dodecane, "Isoper E", "Isoper G", "Isoper H", "Isoper L", "Shellsol 70", "Shellsol 71", "Amsco OMS" and "Amsco 460" can be used individually or in the form of mixtures thereof.

Solvents which can be used in admixture with these organic solvents include alcohols (for example, methyl alcohol, ethyl alcohol, propyl alcohol, butyl alcohol, fluorinated alcohol), ketones (for example, acetone, methyl ethyl ketone, cyclohexanone), carboxylic acid esters (for example, methyl acetate, ethyl acetate, propyl acetate, butyl acetate, methyl propionate, ethyl propionate), ethers (for example, diethyl ether, dipropyl ether, tetrahydrofuran, dioxane), and halogenated hydrocarbons (for example, methylene dichloride, chloroform, carbon tetrachloride, dichloroethane and methylchloroform).

The non-aqueous solvents which are used in admixture with these solvents are preferably distilled off by heating or by reducing the pressure after the particles have been formed by polymerization, but they may be included in the latex particle dispersion for the liquid developer without causing problems provided that the a resistance of at least $10^9$ Ω.cm is still maintained by the developer liquid.

The use, during the preparation of the resin dispersion, of the same solvent as that used for the carrier liquid is normally preferred and, as mentioned earlier, it is possible to use linear or branched chain aliphatic hydrocarbons, alicyclic hydrocarbons, aromatic hydrocarbons and halogenated hydrocarbons, for example, for this purpose.

The resin for dispersion stabilization purposes which is used in this invention to form the solvent insoluble copolymer formed by copolymerizing the monofunctional monomer (A) and the macromonomer (B) in the non-aqueous solvent into a stable resin dispersion is a polymer in which a polymerizable double bond group which can copolymerize with the mono-functional monomer (A) is bound only to the end of the main chain of a polymer which includes at least one type of repeating unit which represented by the general formula (I).

The aliphatic groups and hydrocarbyl groups present in the repeating unit represented by general formula [I] may be substituted.

In general formula [I], X preferably represents —COO—, —OCO—, —$CH_2$OCO—, —$CH_2$COO— or —O— and, more preferably , X represents —COO—, $CH_2$COO— or —O—.

Y preferably represents an aralkyl group, an alkenyl group or an alkyl group which each has from 8 to 22 carbon atoms and which may be substituted. Examples of suitable substituent groups include halogen atoms (for example, fluorine, chlorine, bromine), —O—$Z_2$, —COO—$Z^2$, and —OCO—$Z^2$ (where $Z^2$ represents an alkyl group which has from 6 to 22 carbon atoms, for example, hexyl, octyl, decyl, dodecyl, hexadecyl, octadecyl). More preferably, Y represents an alkenyl group or an alkyl group which has from 8 to 22 carbon atoms, for example, octyl, decyl, dodecyl, tridecyl, tetradecyl, hexadecyl, octadecyl, docosanyl, octenyl, decenyl, dodecenyl, tetradecenyl or octadecenyl.

Moreover, $a_1$ and $a_2$ may be the same or different, and they preferably represent hydrogen atoms, halogen atoms (for example, fluorine, chlorine, bromine), cyano groups, alkyl groups which have from 1 to 3 carbon atoms, —COO—$Z^1$ groups or —$CH^2$COO—$Z^1$ groups (where $Z^1$ preferably represents an aliphatic group which has from 1 to 18 carbon atoms). More preferably, $a_1$ and $a_2$ may be the same or different and each represents a hydrogen atom, an alkyl group which has from 1 to 3 carbon atoms (for example, methyl, ethyl, propyl), a —COO—$Z^1$ group or a —$CH_2$COO—$Z^1$ group (where $Z^1$ most preferably represents an alkenyl group or an alkyl group which has up to 18 carbon atoms, for example, methyl, ethyl, propyl, butyl, hexyl, octyl, decyl, dodecyl, tridecyl, tetradecyl, hexadecyl, octadecyl, butenyl, hexenyl, octenyl, decenyl, dodecenyl, tetradecenyl, or octadecenyl, and these alkyl and alkenyl groups may have substituent groups similar to those described in connection with Y).

The polymerizable double bond groups which are bound to one end of the polymer main chain are groups which can copolymerize with the mono-functional monomer (A), and specific examples of such groups are shown below.

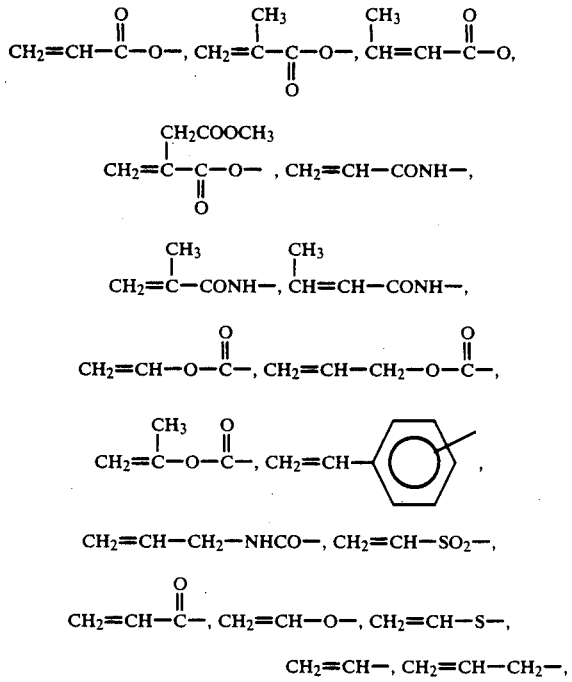

These polymerizable double bond groups have a chemical structure which is bonded directly to one end of the polymer main chain or which is bonded thereto through an optional linking group.

These linking groups can have a structure comprising any combination of atomic groups including carbon—carbon bonds (single or double bonds), carbon—hetero atom bonds (where the hetero atom is oxygen, sulfur, nitrogen or silicon, for example), and hetero atom—hetero atom bonds. For example, the linking group may be a single linking group selected from a

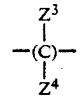

group (where $Z^3$ and $Z^4$ each represents hydrogen atom, a halogen atom (for example, fluorine, chlorine, bromine), cyano group, hydroxyl group, an alkyl group (for example, methyl, ethyl, propyl), —(CH=CH)—,

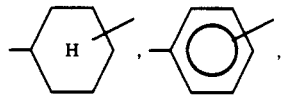

—O—, —S—,

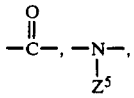

—COO—, —$SO_2$—, $$-\underset{\underset{Z^5}{|}}{CON}-,\ -\underset{\underset{Z^5}{|}}{SO_2N}-,$$

—NHCOO—, —NHCONH—, $$-\overset{\overset{Z^5}{|}}{\underset{\underset{Z^6}{|}}{Si}}-$$

where $Z^5$ and $Z^6$ each represents hydrogen atom or hydrocarbyl group which have the same meaning as $Z^1$ in the aforementioned general formula (I)), or any combination of these groups.

The polymer component of the resins for dispersion stabilization purposes of this present invention can be a homopolymer or copolymer component of repeating units selected from those represented by the general formula (I), or a copolymer component obtained by polymerizing monomers corresponding to repeating units represented by general formula (I) and other polymerizable monomers. Other monomers which can form copolymer components with the polymer components represented by general formula (I) include, for example, compounds which can be represented by the general formula (IV).

$$\overset{e^1}{\underset{|}{CH}}=\overset{e^2}{\underset{\underset{U-Z^7}{|}}{C}} \qquad \text{(IV)}$$

U in general formula (IV) represents —COO—, —OCO—, —$CH_2OCO$—, —$CH_2COO$—, —O—, $$-OCO-,\ -CH_2OCO-,\ -CH_2COO-,\ -O-,\ -\underset{\underset{Z^8}{|}}{CON}-,$$

$$-\underset{\underset{Z^8}{|}}{SO_2N}- \text{ or } -\bigcirc$$

Here, $Z^8$ represents a hydrogen atom or an aliphatic group which has from 1 to 18 carbon atoms and which may be substituted (for example, methyl, ethyl, propyl, butyl, 2-chloroethyl, 2-bromoethyl, 2-cyanoethyl, 2-hydroxyethyl, benzyl, chlorobenzyl, methylbenzyl, methoxybenzyl, phenethyl, 3-phenylpropyl, dimethylbenzyl, fluorobenzyl, 2-methoxyethyl, 3-methoxypropyl).

$Z^7$ represents a hydrogen atom or an aliphatic group which has from 1 to 6 carbon atoms and which may be substituted (for example, methyl, ethyl, propyl, butyl, 2-chloroethyl, 2,2-dichloroethyl, 2,2,2-trifluoroethyl, 2-bromoethyl, 2-glycidylethyl, 2-hydroxyethyl, 2-hydroxypropyl, 2,3-dihydroxyethyl, 2-hydroxy-3-chloropropyl, 2-cyanoethyl, 3-cyanopropyl, 2-nitroethyl, 2-methoxyethyl, 2-methanesulfonylethyl, 2-ethoxyethyl, N,N-dimethylaminoethyl, N,N-diethylaminoethyl, trimethoxysilylpropyl, 3-bromopropyl, 4-hydroxybutyl, 2-furfurylethyl, 2-thienylethyl, 2-pyridylethyl, 2-morpholinoethyl, 2-carboxyethyl, 3-carboxypropyl, 4-carboxybutyl, 2-phosphoethyl, 3-sulfopropyl, 4-sulfobutyl, 2-carboxyamidoethyl, 3-sulfoamidopropyl, 2-N-methylcarboxyamidoethyl, cyclopentyl, chlorocyclohexyl, dichlorohexyl).

Moreover, $e^1$ and $e^2$ may be the same or different, and each has the same meaning as $a^1$ or $a^2$ in the aforementioned general formula [I].

Specific examples of monomers represented by general formula [IV]include vinyl esters or allyl esters of aliphatic carboxylic acids which have from 1 to 6 carbon atoms (for example, acetic acid, propionic acid, butyric acid, monochloroacetic acid, trifluoropropionic acid), alkyl esters, wherein the alkyl groups have from 1 to 4 carbon atoms and may be substituted, or amides of unsaturated carboxylic acids, such as acrylic acid, methacrylic acid, crotonic acid, itaconic acid and maleic acid (examples of the alkyl groups include methyl, ethyl, propyl, butyl, 2-chloroethyl, 2-bromoethyl, 2-fluoroethyl, trifluoroethyl, 2-hydroxyethyl, 2-cyanoethyl, 2-nitroethyl, 2-methoxyethyl, 2-methanesulfonylethyl, 2-benzenesulfonylethyl, 2-(N,N-dimethylamino)ethyl, 2-(N,N-diethylamino)ethyl, 2-carboxyethyl, 2-phosphoethyl, 4-carboxybutyl, 3-sulfopropyl, 4-sulfobutyl, 3-chloropropyl, 2-hydroxy-3-chloropropyl, 2-furfurylethyl, 2-pyridinylethyl, 2-thienylethyl, trimethoxysilylpropyl, 2-carboxyamidoethyl), styrene derivatives (for example, styrene, vinyltoluene, α-methylstyrene, vinylnaphthalene, chlorostyrene, dichlorostyrene, bromostyrene, vinylbenzenecarboxylic acid, vinylbenzenesulfonic acid, chloromethylstyrene, hydroxymethylstyrene, methoxymethylstyrene, N,N-dimethylaminomethylstyrene, vinylbenzenecarboxyamide, vinylbenzenesulfoamide), unsaturated carboxylic acids such as acrylic acid, methacrylic acid, crotonic acid, maleic acid and itaconic acid, for example, or the cyclic anhydrides of maleic acid and itaconic acid, acrylonitrile, methacrylonitrile, and heterocyclic compounds which contain a polymerizable double bond (such as the compounds disclosed in *The Polymer Data Handbook, Fundamentals Edition,* pages 175 to 184, Polymer Society (published by Baifukan, 1986), for example N-vinylpyridine, N-vinylimidazole, N-vinylpyrrolidone, vinylthiophene, vinyltetrahydrofuran, vinyloxazoline, vinylthiazole and N-vinylmorpholine).

Two or more of the monomers represented by general formula (IV) can be used in combination, if desired.

The aforementioned repeating unit represented by general formula (I) comprises from 30 wt % to 100 wt %, and preferably for from 50 wt % to 100 wt %, of the resin polymer for dispersion stabilization purposes used in this invention.

The resin for dispersion stabilization purposes of this present invention which has a polymerizable double bond bound only at one end of the main polymer chain can be prepared easily using methods in which a polymerizable double bond group is introduced by reacting various reagents which contain a polymerizable double bond with living polymers which are obtained by conventional methods of anionic or cationic polymerization, or in which an agent which contains a "specified reactive group" (for example, —OH, —COOH, —$SO_3H$, —$NH_2$, —SH, —$PO_3H_2$, —NCO, —NCS, $$-\overset{O}{\diagup\!\!\!\diagdown}CH-CH_2,$$

—COCl, —$SO_2Cl$) is reacted with the end of such living polymer, after which a polymerizable double bond group is introduced (methods involving ionic polymerization), or methods in which radical polymerization is carried out using polymerization initiators and/or chain transfer agents which contain the aforementioned "specified reactive groups" within the molecule, and in which a polymerizable double bond group is then introduced by way of a polymer reaction using the "specified reactive groups" which are bond only at the end of the main polymer chains.

In practice, these resins can be prepared using the methods disclosed in reviews, such as those by P. Dreyfuss & R. P. Quirk, *Encycl. Polym. Sci. Eng.*, 7, 551 (1987), Chujo & Yamashita, *Dyes and Reagents*, 30, 232 (1985), Ueda and Nagai, *Science & Industry*, 60, 57 (1986), P. F. Rempp & E. Franta, *Advances in Polymer Science*, 58, 1 (1984), Ito, *Polymer Processing*, 35, 262 (1986), V. Percec, *Applied Polymer Science*, 285, 97 (1984), for example, and in the literature cited therein.

The weight average molecular weight of the resin for dispersion stabilization purposes used in this invention is preferably from $1\times10^4$ to $5\times10^5$, and more preferably from $2\times10^4$ to $2\times10^5$.

Specific examples of resins for dispersion stabilization purposes which can be used in the invention are indicated below, but the invention is not to be construed as being limited to these examples.

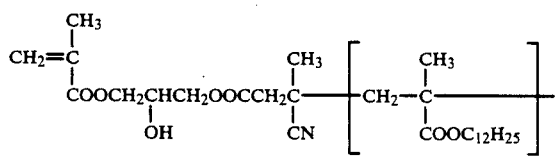
(I-1)

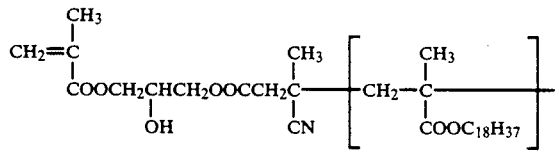
(I-2)

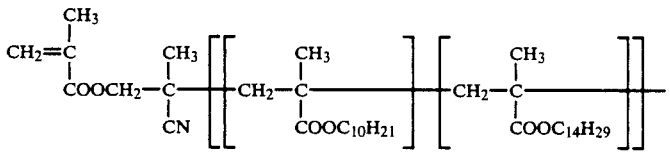
(I-3)

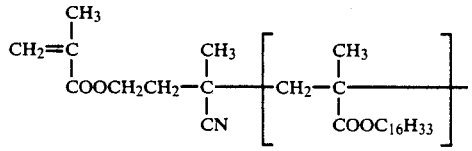
(I-4)

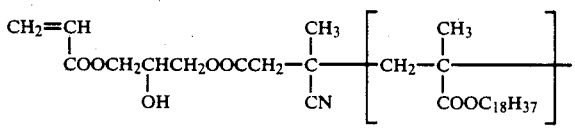
(I-5)

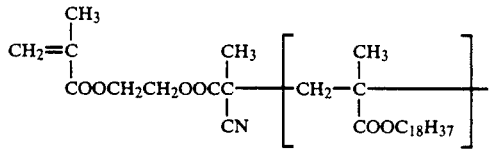
(I-6)

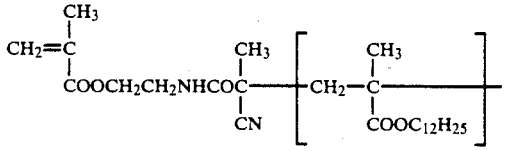
(I-7)

-continued
(I-8)
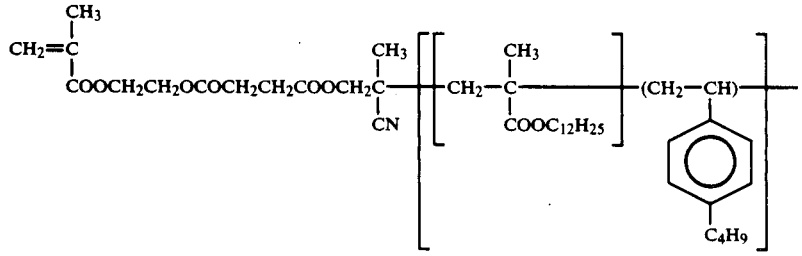
(I-9)
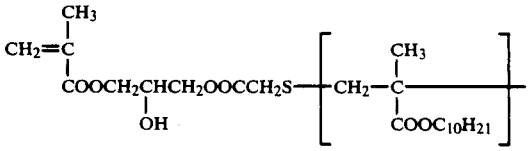
(I-10)
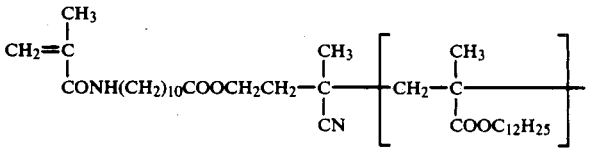
(I-11)
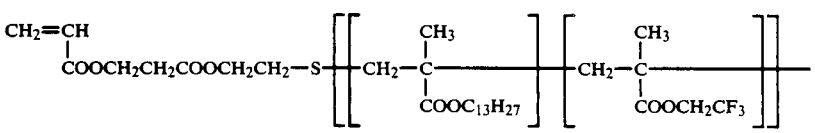
(I-12)
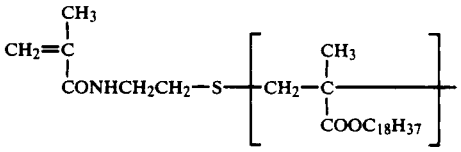
(I-13)
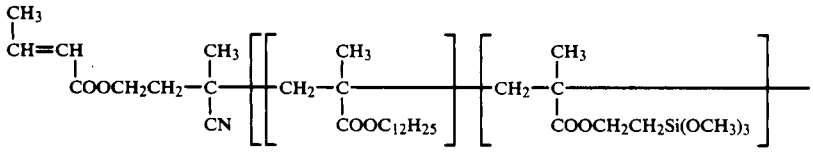
(I-14)
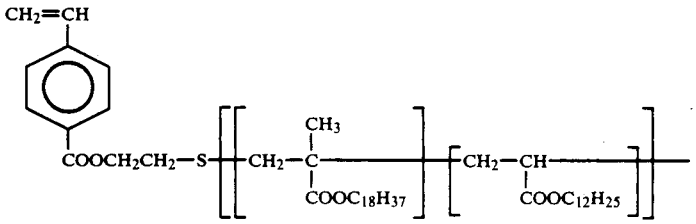
(I-15)
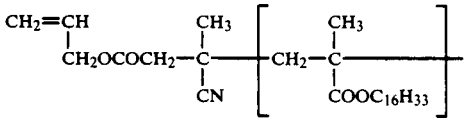
(I-16)
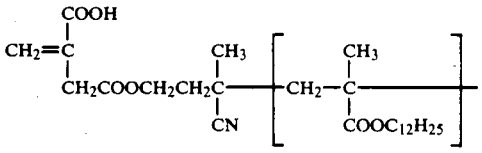

-continued

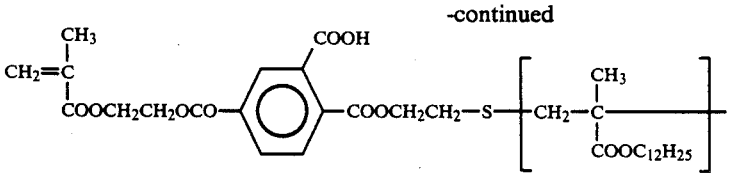

(I-17)

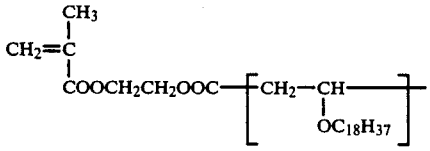

(I-18)

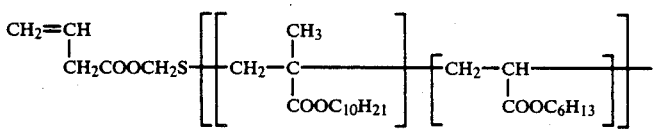

(I-19)

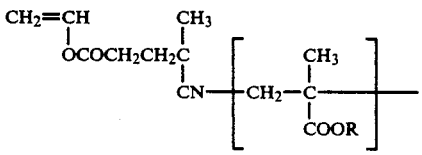

(I-20)

R: alkyl group having 10 to 22 carbon atoms

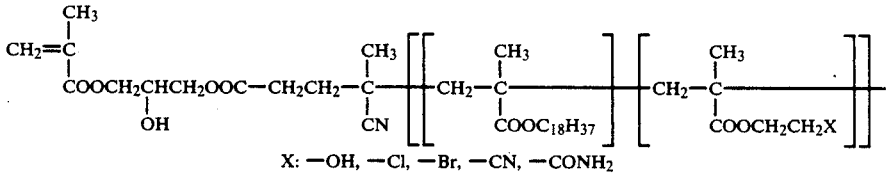

(I-21)

X: —OH, —Cl, —Br, —CN, —$CONH_2$

The monomers used when preparing the non-aqueous based dispersed resins are soluble in non-aqueous solvents but they can be classified into monofunctional monomers (A) which are rendered insoluble by polymerization, and mono-functional macromonomers which form copolymers with the monofunctional monomers (A).

The monofunctional monomer (A) in this invention may be any monofunctional monomer which is soluble in non-aqueous solvents and rendered insoluble by polymerization. Specific examples of such monomers include those represented by the general formula (V).

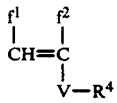

(V)

In general formula (V), V represents —COO—, —OCO—, —$CH_2OCO$—, —$CH_2COO$—, —O—,

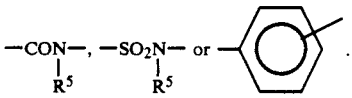

Here, $R^5$ represents a hydrogen atom or an aliphatic group which has from 1 to 18 carbon atoms and which may be substituted (for example, methyl, ethyl, propyl, butyl, 2-chloroethyl, 2-bromoethyl, 2-cyanoethyl, 2-hydroxyethyl, benzyl, chlorobenzyl, methylbenzyl, methoxybenzyl, phenethyl, 3-phenylpropyl, dimethylbenzyl, fluorobenzyl, 2-methoxyethyl, 3-methoxypropyl).

$R^4$ represents a hydrogen atom or an aliphatic group which has from 1 to 6 carbon atoms which may be substituted (for example, methyl, ethyl, propyl, butyl, 2-chloroethyl, 2,2-dichloroethyl, 2,2,2-trifluoroethyl, 2-bromoethyl, 2-glycidylethyl, 2-hydroxyethyl, 2-hydroxypropyl, 2,3-dihydroxyethyl, 2-hydroxy-3-chloropropyl, 2-cyanoethyl, 3-cyanopropyl, 2-nitroethyl, 2-methoxyethyl, 2-methanesulfonylethyl, 2-ethoxyethyl, N,N-dimethylaminoethyl, N,N-diethylaminoethyl, trimethoxysilylpropyl, 3-bromopropyl, 4-hydroxybutyl, 2-furfurylethyl, 2-thienylethyl, 2-pyridylethyl, 2-morpholinoethyl, 2-carboxyethyl, 3-carboxypropyl, 4-carboxybutyl, 2-phosphoethyl, 3-sulfopropyl, 4-sulfobutyl, 2-carboxyamidoethyl, 3-sulfoamidopropyl, 2-N-methylcarboxyamidoethyl, cyclopentyl, chlorocyclohexyl, dichlorohexyl).

Moreover, $f^1$ and $f^2$ may be the same or different and each has the same meaning as $b^1$ or $b^2$ in the aforementioned general formula [II].

Specific examples of the monofunctional monomer (A) include the vinyl esters or allyl esters of aliphatic carboxylic acids which have from 1 to 6 carbon atoms (for example, acetic acid, propionic acid, butyric acid, monochloroacetic acid, trifluoropropionic acid), alkyl esters, wherein the alkyl groups having from 1 to 4 carbon atoms and may be substituted (examples of such alkyl groups include methyl, ethyl, propyl, butyl, 2-chloroethyl, 2-bromoethyl, 2-fluoroethyl, trifluoroethyl, 2-hydroxyethyl, 2-cyanoethyl, 2-nitroethyl, 2-methoxyethyl, 2-methanesulfonylethyl, 2-benzenesulfonylethyl, 2-(N,N-dimethylamino)ethyl, 2-(N,N-diethylamino)ethyl, 2-carboxyethyl, 2-phosphoethyl, 4-carboxybutyl, 3-sulfopropyl, 4-sulfobutyl, 3-chloropropyl, 2-hydroxy- 3-chloropropyl, 2-furfurylethyl, 2-pyridinylethyl, 2-thienylethyl, trimethoxysilylpropyl and 2-carboxyamidoethyl) or amides of unsaturated carboxylic acids such as acrylic acid, methacrylic acid, crotonic acid, itaconic acid and maleic acid, styrene derivatives (for example, styrene vinyltoluene, o-methylstyrene, vinylnaphthalene, chlorostyrene, dichlorostyrene, bromostyrene, vinylbenzenecarboxylic acid, vinylbenzenesulfonic acid, chloromethylstyrene, hydroxymethylstyrene, methoxymethylstyrene, N,N-dimethylaminomethylstyrene, vinylbenzenecarboxamide, vinylbenzenesulfoamide), unsaturated carboxylic acids such as acrylic acid, methacrylic acid, crotonic acid, maleic acid or itaconic acid, for example, or cyclic anhydrides of maleic acid or itaconic acid, acrylonitrile, methacrylonitrile, and heterocyclic compounds which contain a polymerizable double bond (actual examples include the compounds disclosed in *Polymer Data Handbook, Fundamentals Edition,* pages 175 to 184, *Polymer Society* (published by Baifukan, 1986), for example, N-vinylpyridine, N-vinylimidazole, N-vinylpyrrolidone, vinylthiophene, vinyltetrahydrofuran, vinyloxazoline, vinylthiazole and N-vinylmorpholine).

Two or more of the monofunctional monomers (A) can be used in combination, if desired.

The monofunctional macromonomer (B) is a macromonomer of number average molecular weight not more than $10^4$ which has a polymerizable double bond group represented by the general formula (III) which can polymerize with the monomer (A) bound only at one end of the main chain of a polymer comprised repeating units represented by the general formula (II).

Moreover, the hydrocarbyl groups included in $b^1$, $b^2$, T, $R^1$, $d^1$, $d^2$ and T' in general formulae (II) and (III) have carbon atoms (for the unsubstituted hydrocarbyl groups) in each case and these hydrocarbyl groups may be substituted hydrocarbyl groups.

In general formula (II), the $R^2$ substituent groups shown in T may be a hydrogen atom, or preferably an alkyl group which has from 1 to 18 carbon atoms (for example, methyl, ethyl, propyl, butyl, heptyl, hexyl, octyl, decyl, dodecyl, hexadecyl, octadecyl, 2-chloroethyl, 2-bromoethyl, 2-cyanoethyl, 2-methoxycarbonylethyl, 2-methoxyethyl, 3-bromopropyl), an alkenyl group which has from 4 to 18 carbon atoms (for example, 2-methyl-1-propenyl, 2-butenyl, 2-pentenyl, 3-methyl-2-pentenyl, 1-pentenyl, 1-hexenyl, 2-hexenyl, 4-methyl-2-hexenyl), aralkyl groups which have from 7 to 12 carbon atoms (for example, benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl, dimethoxybenzyl), an alicyclic group which has from 5 to 8 carbon atoms (for example, cyclohexyl, 2-cyclohexylethyl, 2-cyclopentylethyl), or an aromatic group which has from 6 to 12 carbon atoms (for example, phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propionamidophenyl, dodecyloylamidophenyl).

Where T represents

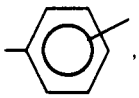

the benzene ring may have substituent groups. These substituent groups include halogen atoms (for example, chlorine, bromine) and alkyl groups (for example, methyl, ethyl, propyl, butyl, chloromethyl, methoxymethyl).

$R^1$ preferably represents a hydrocarbyl group which has from 1 to 18 carbon atoms, and, more specifically, in practical terms it represents the same hydrocarbyl groups as described above for $R^2$.

Moreover, $b^1$ and $b^2$ may be the same or different and each preferably represents a hydrogen atom, a halogen atom (for example, chlorine, bromine), a cyano group, an alkyl group which has from 1 to 3 carbon atoms (for example, methyl, ethyl, propyl), a —COO—$R^3$ group or a —$CH_2COOR^3$ group (where $R^3$ represents a hydrogen atom or an aryl group, alicyclic group, aralkyl group or alkyl group which has from 1 to 18 carbon atoms and which may be substituted, and the details thereof are the same as those described above in connection with $R^2$.

In general formula [III], T' as the same meaning as T in formula [II], and $d^1$ and $d^2$ may be the same or different, having the same significance as $b^1$ and $b^2$ in the above mentioned formula [II]. The preferred scope for T', $d^1$ and $d^2$ is the same as that described above for T, $b^1$ and $b^2$ respectively.

It is preferred that either one of $b^1$ and $b^2$ in formula [II] or $d^1$ and $d^2$ in formula [III] is a hydrogen atom.

As described above, the macromonomer in this invention has a chemical structure such that a polymerizable double bond group represented by the general formula (III) is bonded directly, or via an optional linking group, to only one end of the main chain of a polymer comprising repeating units represented by general formula (II). The group which links the moiety of formula (II) and the moiety of formula (III) can be any combination of groups of atoms such as carbon-carbon bonds (single bonds or double bonds), carbon-hetero atom bonds (where the hetero atom is oxygen, sulfur, nitrogen or silicon, for example), and hetero atom—hetero atom bonds.

Preferred macromonomers (B) of this invention are represented by the formula (VI).

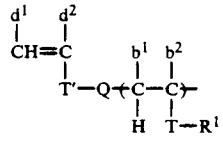

(VI)

In formula (VI), $b^1$, $b^2$, $d^1$, $d^2$, T, $R^1$ and T' each have the same meaning as described in connection with formulae (II) and (III).

Q represents a single bond or a linking group comprising a single linking group or an optional combination or linking groups selected from groups of atoms such as

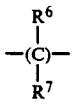

[where $R^6$ and $R^7$ each represents a hydrogen atom, a halogen atom (for example, fluorine, chlorine, bromine), a cyano group, a hydroxyl group, an alkyl group (for example, methyl, ethyl, propyl)],

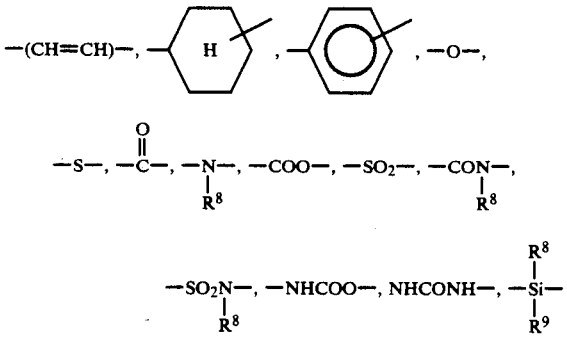

[where $R^8$ and $R^9$ each represents a hydrogen atom or a hydrocarbyl group which has the same meaning as the aforementioned $R^2$ group].

Printing durability (press life) falls if the upper limit for the number average molecular weight of the macromonomer (B) exceeds $1\times10^4$. On the other hand, there is a tendency for contamination to arise if the molecular weight is too low and, thus, so a molecular weight of at least $1\times10^3$ is preferred.

Especially preferred examples of T, $R^1$, T', $b^1$, $b^2$, $d^1$ and $d^2$ in the aforementioned general formulae (II), (III), and (VI) are described below.

T is preferably —COO—, —OCO—, —O—, —$CH_2$COO—, or —$CH_2$OCO—, $R^1$ is preferably an alkenyl group or an alkyl group which has not more than 18 carbon atoms, T' is preferably any of the groups aforementioned (but in which $R^2$ is a hydrogen atom), and $b^1$, $b^2$, $d^1$, and $d^2$ are preferably hydrogen atoms or methyl groups.

The macromonomers (B) of this present invention can be prepared using conventional methods of synthesis. For example, they can be prepared using methods in which various reagents are reacted with the end of a living polymer which is being produced using anionic polymerization or cationic polymerization to form the macromer using an ionic polymerization method, methods in which various reagents are reacted with oligomers which have reactive terminal groups obtained by radical polymerization using polymerization initiators and/or chain transfer agents which contain reactive groups such as carboxyl groups, hydroxyl groups, amino groups, for example, within the molecule and forming the macromer using radical polymerization, and methods in which the polymerizable double bond groups are introduced into poly-addition or poly-condensation polymers in the same way as in the above mentioned radical polymerization methods, i.e., introduced into oligomers which have been obtained by poly-addition or poly-condensation reactions.

In practical terms, the macromonomers (B) can be prepared using the methods disclosed in the reviews indicated below and the literature and patents, etc. cited therein. For example, suitable methods are described by P. Dreyfuss & R. P. Quirk, *Encycl. Polym. Sci. Eng.*, 7, 551, (1987), P. F. Rempp & E. Fanta, *Adv. Polym. Sci.*, 58, 1 (1984), V. Percec, *Appl. Polym. Sci.*, 285, 95 (1984), R. Asami, M. Takari, *Makramol. Chem. Suppl.*, 12, 163, (1985), Kawakami, *Kagaku Kogyo*, 38, 56 (1987), Yamashita, *Kobunshi*, 31, 988 (1982), Kobayashi, *Kobunshi*, 30, 625 (1981), Higashimura, *Nippon Setchaku Kyokaishi*, 18, 536 (1982), Ityo, *Kobunshi Kako*, 35, 262 (1968), and Azuma & Tsuda, *Kino Zairyo*, 1987, No. 10, 5.

Specific examples of macromonomers (B) of this present invention include the compounds indicated below. However, the scope of the invention is not to be construed as being limited to these examples.

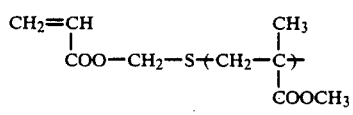

(B)-1

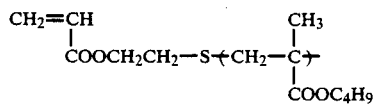

(B)-2

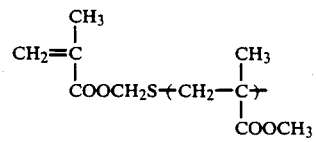

(B)-3

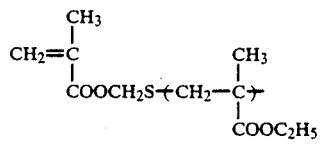

(B)-4

-continued
(B)-5
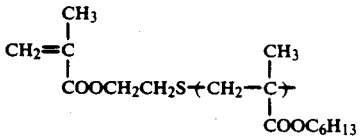
(B)-6
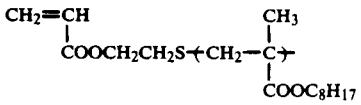
(B)-7
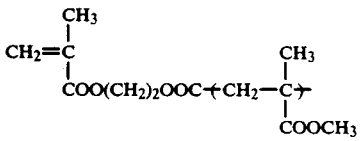
(B)-8
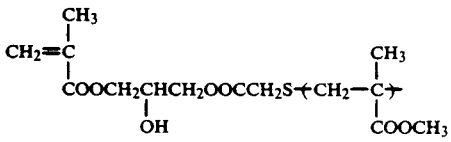
(B)-9
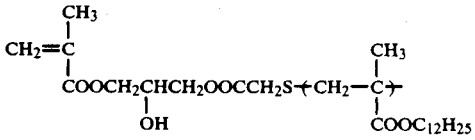
(B)-10
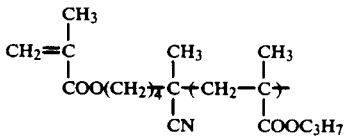
(B)-11
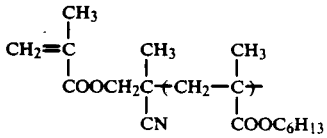
(B)-12
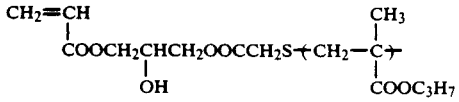
(B)-13
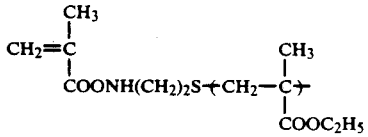
(B)-14
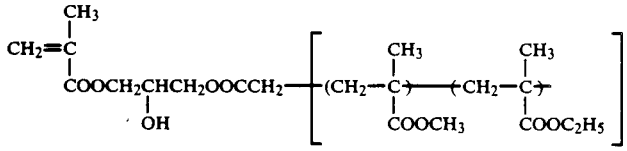
(B)-15
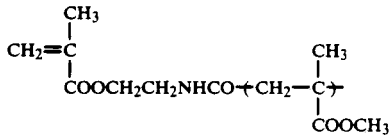

-continued
(B)-16
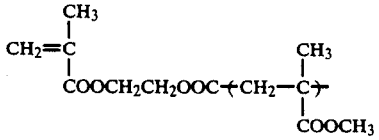
(B)-17
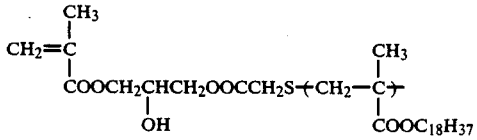
(B)-18
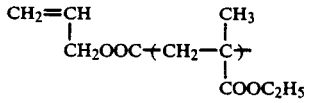
(B)-19
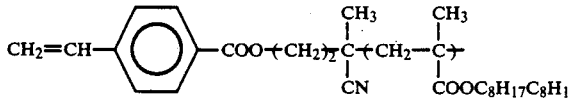
(B)-20
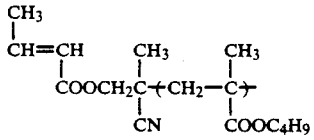
(B)-21
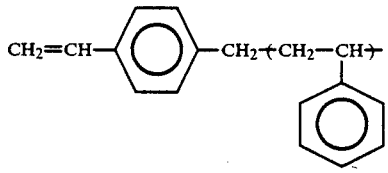
(B)-22
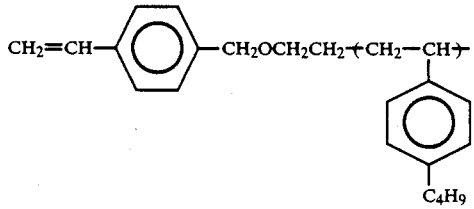
(B)-23
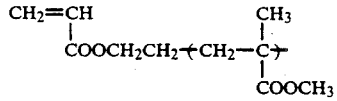
(B)-24
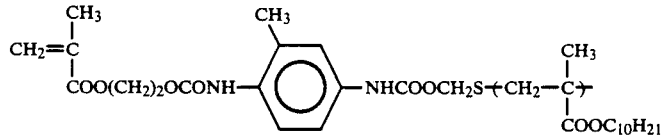
(B)-25
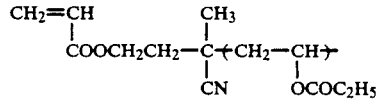
(B)-26
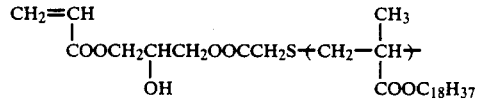

-continued

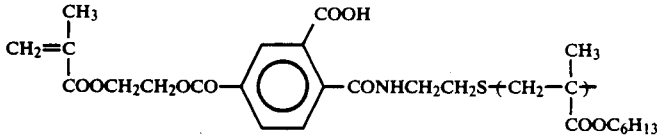
(B)-27

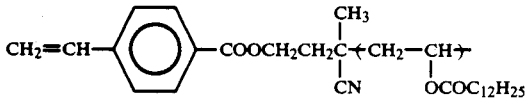
(B)-28

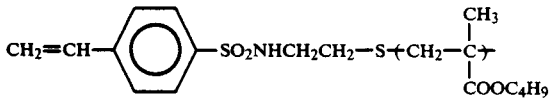
(B)-29

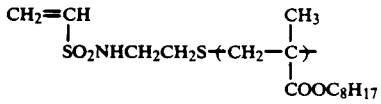
(B)-30

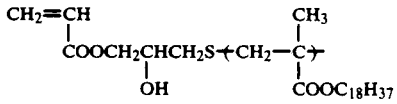
(B)-31

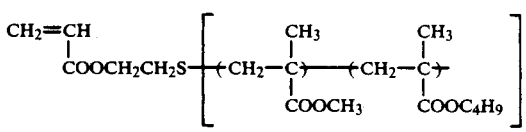
(B)-32

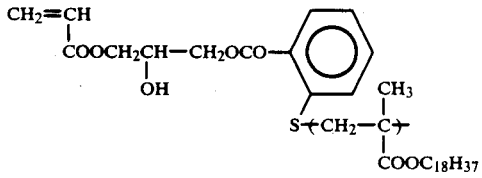
(B)-33

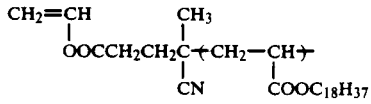
(B)-34

The dispersed resins of the present invention comprise at least one monomer (A) and at least one macromonomer (B). The important point here is that the prescribed dispersed resins are obtained provided that the resin comprising these monomers is insoluble in the non-aqueous solvents. In more specific terms, the amount of the macromonomer (B) used is preferably from 0.1 to 10 wt %, and more preferably from 0.2 to 5 wt %, with respect to the insolubilized monomer (A). Most preferably, the amount used is within the range from 0.3 to 3 wt %. Furthermore, the molecular weight of the dispersed resin of this present invention is from $10^3$ to $10^6$, and most preferably from $10^4$ to $5\times10^5$.

As described above, the dispersed resins used in the invention can be prepared in general by polymerization of a resin for dispersion stabilization purposes as described earlier, a monomer (A) and a macromonomer (B) with heat in a non-aqueous solvent in the presence of a polymerization initiator such as benzoyl peroxide, azobisisobutyronitrile or butyl lithium, for example.

More specifically, the dispersed resin can be prepared using methods in which a polymerization initiator is added to a solution containing a mixture of the resin for dispersion stabilization purposes, monomer (A) and macromonomer (B), methods in which monomer (A) and macromonomer (B) are drip fed along with a polymerization initiator into a solution which contains the resin for dispersion stabilization purposes, methods in which part of a mixture of the monomer (A) and the macromonomer (B) are dissolved with all of the resin for dispersion stabilization purposes to form a solution to which the remainder of the monomer mixture is added arbitrarily, together with the polymerization initiator, and methods in which a mixture of the resin for dispersion stabilization purposes and monomer are added arbitrarily together with the polymerization initiator to a non-aqueous solvent.

The total amount of monomer (A) and macromonomer (B) is within the range from about 5 to 80 parts by weight, and preferably from 10 to 50 parts by weight, per 100 parts by weight of non-aqueous solvent.

The soluble resin which is the dispersion stabilizing agent is used at a rate of from 1 to 100 parts by weight, and preferably at a rate of from 5 to 50 parts by weight, per 100 parts of all the above mentioned monomer which is used.

The amount of polymerization initiator is suitably from 0.1% to 5% (by weight) with respect to the total amount of monomer.

The polymerization temperature is from 50° to 180° C., and preferably from 60° to 120° C. The reaction time is preferably from 1 to 15 hours.

Where polar solvents, such as the aforementioned alcohols, ketones, ethers, esters for example, are used in combination with the non-aqueous solvents used in the reaction, and in cases in which unreacted monomer (A) which is being polymerized to form particles is present after reaction, the solvent or monomer is preferably distilled off by raising the temperature above the boiling point of the solvent or monomer, or by distillation under reduced pressure.

The non-aqueous based dispersed particles prepared in accordance with the present invention in the manner described above exist as fine particles which have a uniform particle size distribution, and, at the same time, they exhibit very stable dispersion properties. The dispersion properties are especially good with long term repetitive use in a developing apparatus. The particles are easily redispersed, even with increased developing speeds. Moreover, no attachment of stains to various parts of the apparatus and contamination is observed at all.

Furthermore, when fixed with heat, for example, a strong film is formed and excellent fixing properties are achieved.

Moreover, the liquid developers of the present invention have excellent dispersion stability, redispersion properties and fixing properties, even when used in rapid development/fixing processes and for large size master plates.

Coloring agents may be used, as desired, in the liquid developers of this invention. No particular limitation is imposed upon the coloring agent, and a variety of pigments and dyes conventionally known can be used for this purpose.

Where the dispersed resin is to be colored itself, the coloration can be achieved, for example, by physical dispersion within the dispersed resin using pigments or dyes, and there are many known pigments and dyes which can be used for this purpose. Examples include magnetic iron oxide powder, powdered lead iodide, carbon black, nigrosine, alkali blue, hanza yellow, quinacridone red and phthalocyanine blue.

The method in which the dispersed resins are dyed with the preferred dyes, as disclosed, for example, in JP-A-57-48738, is another method of coloration. Alternatively, the dyes can be chemically bonded to the dispersed resin, as disclosed in JP-A-53-54029, or a monomer which contains a pre-colorant can be used when preparing the polymerized particles to provide a colorant containing copolymer as disclosed, for example, in JP-B-44-22955. (The term "JP-B" as used herein signifies an "examined Japanese patent publication".)

Various additives can be included, as desired, in the liquid developers of this invention to provide reinforcing charging characteristics or to improve image characteristics, and actual examples of such additives are disclosed in Harazaki, *Electrophotography*, Vol. 16, No. 2, page 44.

For example, metal salts of di-2-ethylhexylsulfosuccinic acid, metal naphthenates, metal salts of higher fatty acids, lecithin, poly(vinylpyrrolidone) and copolymers which contain a hemi-maleic acid amide components can be used.

The amounts of each of the principal components in a liquid developer of this invention are described below.

Toner particles comprising a resin, with a colorant, as desired, as a principal component are preferably present in an amount of from 0.5 to 50 parts by weight per 1,000 parts by weight of carrier liquid. If the amount used is less than 0.5 part by weight the image density obtained is insufficient, and, if more than 50 parts by weight are used, then fogging tends to occur in non-image parts. Moreover, the aforementioned carrier liquid soluble resin for dispersion stabilization purposes can also be used, as desired, and it can be employed at a rate ranging from 0.5 to 100 parts by weight per 1,000 parts by weight of carrier liquid. Charging control agents of the type referred to above are preferably used at a rate of from 0.001 to 1.0 part by weight per 1,000 parts by weight of carrier liquid. Moreover, various additives may be present, as desired, and the total amount of these additives is limited at the upper level by the electrical resistance of the developer. That is to say, it is difficult to obtain good quality continuous tone images if the electrical resistance of the liquid developer in the state where the toner particles are not present is lower than $10^9$ Ω·cm and so the amount of the various additives added must be controlled within these limits.

Examples of the invention are described below, but the invention is not to be construed as being limited by these examples.

SYNTHESIS EXAMPLE 1

PREPARATION OF RESIN FOR DISPERSION STABILIZATION PURPOSES

Preparation of Resin P-1 for Dispersion Stabilization Purposes

A liquid mixture comprising 100 grams of octadecyl methacrylate, 150 grams of toluene and 50 grams of isopropanol was heated to a temperature of 75° C. with agitation under a blanket of nitrogen. Next, 30 grams of 2,2'-azobis(4-cyanovalerianic acid) (referred to hereinafter as A.C.V) was added and the mixture was reacted for a period of 8 hours. After cooling, the mixture was reprecipitated in 2 liters of methanol and a white powder was recovered by filtration and dried. A mixture of 50 grams of the white powder so obtained, 3.3 grams of vinyl acetate, 0.025 gram of silver acetate, 0.2 gram of hydroguinone and 100 grams of toluene was heated to 40° C. and reacted for a period of 2 hours. The temperature was then raised to 70° C., $3.8\times10^{-3}$ ml of 100% sulfuric acid was added and the mixture was reacted for a period of 10 hours. The mixture was then cooled to 25° C., 0.02 gram of sodium acetate trihydrate was added and, after agitating for 30 minutes, the mixture was reprecipitated in 1.5 liters of methanol, whereupon 38 grams of a slightly brown colored powder was recovered by filtration and dried. The weight average molecular weight ($\overline{M}w$) of this powder was 38,000.

SYNTHESIS EXAMPLES 2 TO 9

PREPARATION OF RESIN FOR DISPERSION STABILIZATION PURPOSES

Preparation of Resins P-2 to P-9

Each of these resins was prepared using the same procedure as in Synthesis Example 1 except that the monomers shown in Table 1 below were used in place of the octadecyl methacrylate used in Synthesis Example 1.

TABLE 1

| Synthesis Example | Resin for Dispersion Stabilization Purposes | Monomer | | Recovery | Mw |
|---|---|---|---|---|---|
| 2 | P-2 | Dodecyl methacrylate | 100 grams | 40 grams | 42,000 |
| 3 | P-3 | Tridecyl methacrylate | 100 grams | 41 grams | 43,000 |
| 4 | P-4 | Octyl methacrylate | 20 grams | 40 grams | 36,000 |
| | | Dodecyl methacrylate | 80 grams | | |
| 5 | P-5 | Octadecyl methacrylate | 70 grams | 45 grams | 38,000 |
| | | Butyl methacrylate | 30 grams | | |
| 6 | P-6 | Dodecyl methacrylate | 95 grams | 39 grams | 34,000 |
| | | N,N-Dimethylaminoethyl methacrylate | 5 grams | | |
| 7 | P-7 | Octadecyl methacrylate | 96 grams | 43 grams | 40,000 |
| | | 2-(trimethylsilyloxy)ethyl methacrylate | 4 grams | | |
| 8 | P-8 | Tetradecyl methacrylate | 95 grams | 42 grams | 43,000 |
| | | 2-hydroxyethyl methacrylate | 5 grams | | |
| 9 | P-9 | Hexadecyl methacrylate | 100 grams | 45 grams | 42,000 |

SYNTHESIS EXAMPLE 10

PREPARATION OF RESIN FOR DISPERSION STABILIZATION PURPOSES

Preparation of Resin P-10

A polymerization reaction was carried out in the same manner as Synthesis Example 1 except that a liquid mixture of 100 grams of dodecyl methacrylate, 150 ml of toluene and 50 grams of iso-propanol was used. After cooling, the reaction mixture was reprecipitated in 2 liters of methanol and a colorless, transparent, sticky material was obtained by decantation and dried. A mixture of 50 grams of the sticky material so obtained, 1.5 grams of glycidyl methacrylate, 1.0 gram of 2,2'-methylenebis(6-tert-butyl-p-cresol), 0.5 gram of N,N-dimethyldodecylamine and 100 grams of toluene was heated to 100° C. and agitated for a period of 12 hours. The reaction mixture was then reprecipitated in 1 liter of methanol and a light yellow sticky material was recovered by decantation and dried. Recovery 39 grams, $\overline{M}w$ 37,000.

SYNTHESIS EXAMPLE 11

PREPARATION OF RESIN FOR DISPERSION STABILIZATION PURPOSES

Preparation of Resin P-11

A liquid mixture of 100 grams of octadecyl methacrylate and 300 grams of toluene was heated to 70° C. with agitation under a blanket of nitrogen. Five grams of 4,4'-azobis(4-cyanopentanol) was then added and the mixture was reacted for 8 hours. The reaction mixture was then cooled, after which 6.2 grams of methacrylic acid anhydride, 0.8 gram of tert-butylhydroquinone and one drop of concentrated sulfuric acid were added and the mixture was agitated for 1 hour at 30° C. and subsequently for 3 hours at 50° C. After cooling, the mixture was reprecipitated in 2 liters of methanol and white powder was recovered by filtration and dried. Recovery 88 grams, $\overline{M}w$ 38,000.

SYNTHESIS EXAMPLE 12

PREPARATION OF RESIN FOR DISPERSION STABILIZATION PURPOSES

Preparation of Resin P-12

A liquid mixture of 100 grams of octadecyl methacrylate and 200 grams of tetrahydrofuran was heated to 70° C. with agitation under a blanket of nitrogen. Four grams of 4,4'-azobis(4-cyanopentanol) was then added and the mixture was reacted for 5 hours, after which 1.0 gram of the above mentioned azobis compound was added and the mixture was reacted for a further period of 5 hours. The reaction mixture was then cooled to 20° C. in a water bath, 3.2 grams of pyridine and 1.0 gram of 2,2'-methylenebis-(6-tert-butyl-p-cresol) was added and the mixture was agitated. Next, 4.2 grams of methacrylic acid chloride was added dropwise to this liquid mixture over a period of 30 minutes in such a way that the reaction temperature did not exceed 25° C. The mixture was then agitated for 4 hours at a temperature of from 20° C. to 25° C. The mixture was then reprecipitated in a mixture of 1.5 liters of methanol and 0.5 liter of water and a white powder was recovered by filtration and dried. Recovery 86 grams, $\overline{M}w$ 33,000.

SYNTHESIS EXAMPLES 13 TO 21

PREPARATION OF RESIN FOR DISPERSION STABILIZATION PURPOSES

Preparation of Resins P-13 to P-21

These resins were prepared in the same manner as in Synthesis Example 12 except that the acid chlorides shown in Table 2 below were used instead of the methacrylic acid chloride used in Synthesis Example 12.

TABLE 2

| Synthesis Example | Resin for Dispersion Stabilization Purposes | Acid Chloride | Amount Used (g) | Recovery (g) | $\overline{M}w$ |
|---|---|---|---|---|---|
| 13 | P-13 | $CH_2{=}CH{-}CH_2{-}COCl$ | 3.6 | 85 | 33,000 |
| 14 | P-14 | $CH_3$ \| $CH{=}CH{-}COCl$ | 4.2 | 84 | " |

TABLE 2-continued

| Synthesis Example | Resin for Dispersion Stabilization Purposes | Acid Chloride | Amount Used (g) | Recovery (g) | $\overline{M}w$ |
|---|---|---|---|---|---|
| 15 | P-15 | 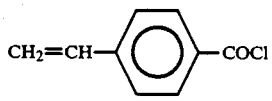 | 6.7 | 89 | " |
| 16 | P-16 | $CH_2{=}CH{-}COOCH_2CH_2COCl$ | 6.5 | 82 | " |
| 17 | P-17 | $CH_2{=}C(CH_3){-}COO(CH_2)_2OCO(CH_2)_2COCl$ | 10.0 | 79 | " |
| 18 | P-18 | $CH_2{=}C(CH_3){-}CONH(CH_2)_{10}COCl$ | 12.1 | 81 | " |
| 19 | P-19 | 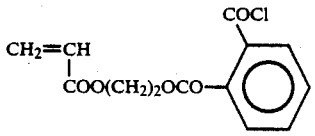 | 11.4 | 82 | " |
| 20 | P-20 | $CH_2{=}C(CH_3){-}COOCH_2CH(Cl)CH_2OCO(CH_2)_3COCl$ | 12.5 | 79 | " |
| 21 | P-21 | $CH_2{=}C(CH_2COOCH_3){-}COCl$ | 6.5 | 80 | " |

SYNTHESIS EXAMPLE 22

PREPARATION OF RESIN FOR DISPERSION STABILIZATION PURPOSES

Preparation of Resin P-22

A liquid mixture of 98.5 grams of dodecyl methacrylate, 1.5 grams of thioglycolic acid and 200 grams of toluene was heated to 70° C. under a blanket of nitrogen. Next, 0.5 gram of 1,1'-azobis(cyclohexane-1-carbonitrile) was added and the mixture was reacted for a period of 5 hours, after which 0.5 gram of the above mentioned azobis compound was added and the mixture was reacted for a further period of 5 hours. Next, 3.0 grams of glycidyl methacrylate, 1.0 gram of tert-butylhydroquinone and 0.6 gram of N,N-dimethylaniline were added and the mixture was reacted at 110° C. for a period of 8 hours. After cooling, the mixture was reprecipitated in 2 liters of methanol and light yellow sticky material was obtained by decantation and dried. Recovery 80 grams, $\overline{M}w$ 33,000.

SYNTHESIS EXAMPLE 23

PREPARATION OF A RESIN FOR DISPERSION STABILIZATION PURPOSES

Preparation of Resin P-23

A liquid mixture of 98.5 grams of hexadecyl methacrylate, 1.5 grams of 2-mercaptoethylamine and 200 grams of tetrahydrofuran was heated to 80° C. under a blanket of nitrogen. Next, 0.3 gram of 1,1'-azobis(cyclohexane-1-carbonitrile) was added and the mixture was reacted for a period of 5 hours, after which 0.3 gram of the above mentioned azobis compound was added and the mixture was reacted for a further period of 5 hours. Next, 2.5 grams of acrylic acid anhydride and 1.0 gram of 2,2'-methylenebis(6-tert-butyl-p-cresol) were added and the mixture was agitated at 40° C. for a period of 5 hours. After cooling, the mixture was reprecipitated in 2 liters of methanol and a colorless sticky material was obtained. Recovery 82 grams, $\overline{M}w$ 20,000.

SYNTHESIS EXAMPLE 24

PREPARATION OF RESIN FOR DISPERSION STABILIZATION PURPOSES

Preparation of Resin P-24

A liquid mixture of 100 grams of dodecyl methacrylate and 200 grams of tetrahydrofuran was heated to 65° C. under a blanket of nitrogen. Next, 6 grams of 2,2'-azobis(4-cyanovalerianic acid chloride) was added and the mixture was agitated for a period of 10 hours. The reaction mixture was then cooled to below 25° C. in a water bath and 2.4 grams of allyl alcohol was added. Next, 2.5 grams of pyridine was added dropwise such that the reaction temperature did not exceed 25° C. and the mixture was agitated for a period of 1 hour. The reaction mixture was then agitated for a period of 2 hours at 40° C. and reprecipitated in 2 liters of methanol. A light yellow sticky material was obtained by decantation and dried. Recovery 80 grams, $\overline{M}w$ 38,000.

SYNTHESIS EXAMPLE 25

PREPARATION OF MACROMONOMER

Preparation of Macromonomer M-1

A liquid mixture of 92 grams of methyl methacrylate, 5 grams of thioglycolic acid and 200 grams of toluene was heated to 75° C. with agitation under a blanket of nitrogen, and then 31 grams of 2,2'-azobis(cyanovalerinanic acid) (referred to hereinafter as A.C.V.) was added and the mixture was reacted for a period of 8 hours. Next, 8 grams of glycidyl methacrylate, 1.0 gram of N,N-dimethyldodecylamine and 0.5 gram of tert-butylhydroquinone were added to the reaction mixture which was subsequently agitated for a period of 12 hours at a temperature of 100° C. After cooling, the reaction mixture was reprecipitated in 2 liters of methanol and 82 grams of a white powder was obtained. The number average molecular weight of the polymer was 6,500.

SYNTHESIS EXAMPLE 26

PREPARATION OF MACROMONOMER

Preparation of Macromonomer M-2

A liquid mixture of 95 grams of methyl methacrylate, 5 grams of thioglycolic acid and 200 grams of toluene was heated to 70° C. with agitation under a blanket of nitrogen, 1.5 grams of 2,2'-azobis-(isobutyronitrile) (referred to hereinafter as A.I.B.N.) was added and the mixture was reacted for 8 hours. Next, 7.5 grams of glycidyl methacrylate, 1.0 gram of N,N-dimethyldodecylamine and 0.8 gram of tert-butylhydroquinone were added to the reaction mixture which was subsequently agitated for 12 hours at 100° C. After cooling, the reaction mixture was reprecipitated in 2 liters of methanol and 85 grams of a colorless, transparent, sticky material was obtained. The number average molecular weight of the polymer was 2,400.

SYNTHESIS EXAMPLE 27

PREPARATION OF MACROMONOMER

Preparation of Macromonomer M-3

A liquid mixture of 94 grams of methyl methacrylate, 6 grams of 2-mercaptoethanol and 200 grams of toluene was heated to 70° C. under a blanket of nitrogen, 1.2 grams of A.I.B.N. was added and the mixture was reacted for a period of 8 hours.

Next, the reaction mixture was cooled to 20° C. in a water bath, 10.2 grams of triethylamine was added and then 14.5 grams of methacrylic acid chloride was added dropwise such that the temperature did not exceed 25° C. The mixture was agitated under the same conditions for a further period of 1 hour after the dropwise addition has been completed, after which 0.5 gram of t-butylhydroquinone was added, the temperature was raised to 60° C. and the reaction mixture was agitated for a period of 4 hours. After cooling, the reaction mixture was reprecipitated in 2 liters of methanol and 79 grams of a colorless, transparent sticky material was obtained. The number average molecular weight was 4,500.

SYNTHESIS EXAMPLE 28

PREPARATION OF MACROMONOMER

Preparation of Macromonomer M-4

A liquid mixture of 95 grams of hexyl methacrylate and 200 grams of toluene was heated to 70° C. under a blanket of nitrogen, 5 grams of 2,2'-azobis-(cyanoheptanol) was added and the mixture was reacted for a period of 8 hours.

After cooling, the reaction mixture was adjusted to a temperature of 20° C. in a water bath, 1.0 grams of triethylamine and 21 grams of methacrylic acid anhydride were added and, after agitating for 1 hour, the mixture was agitated at 60° C. for a period of 6 hours.

The reaction mixture obtained was cooled and then reprecipitated in 2 liters of methanol whereupon 75 grams of a colorless, transparent, sticky material was obtained. The number average molecular weight was 6,200.

SYNTHESIS EXAMPLE 29

PREPARATION OF MACROMONOMER

Preparation of Macromonomer M-5

A mixture of 93 grams of dodecyl methacrylate, 7 grams of 3-mercaptopropionic acid, 170 grams of toluene and 30 grams of iso-propanol was heated to 70° C. under a blanket of nitrogen and a uniform solution was obtained. Next, 2.0 grams of A.I.B.N. was added and the mixture was reacted for a period of 8 hours. After cooling, the reaction mixture was reprecipitated in 2 liters of methanol and the solvent was removed by heating 50° C. under reduced pressure. The sticky material so obtained was dissolved in 200 grams of toluene, 16 grams of glycidyl methacrylate, 1.0 gram of N,N-dimethyldodecylmethacrylate and 1,0 gram of t-butylhydroquinone were added and the mixture was agitated at 110° C. for a period of 10 hours. The reaction mixture was then again reprecipitated in 2 liters of methanol. The number average molecular weight of the light yellow colored sticky material so obtained was 3,400.

SYNTHESIS EXAMPLE 30

PREPARATION OF MACROMONOMER

Preparation of Macromonomer M-6

A liquid mixture of 95 grams of octadecyl methacrylate, 5 grams of thioglycolic acid and 200 grams of toluene was heated to 75° C. with agitation under a blanket of nitrogen, 1.5 grams of A.I.B.N. was added and the mixture was reacted for a period of 8 hours. Next, 13 grams of glycidyl methacrylate, 1.0 gram of N,N-dimethyldodecylamine and 1.0 gram of tert-butylhydroquinone were added and the mixture was agitated at 110° C. for a period of 10 hours. After cooling, the reaction mixture was reprecipitated in 2 liters of methanol and 86 grams of a white powder was obtained. The number average molecular weight was 2,300.

SYNTHESIS EXAMPLE 31

PREPARATION OF MACROMONOMER

Preparation of Macromonomer M-7

A mixture of 40 grams of methyl methacrylate, 54 grams of ethyl methacrylate, 6 grams of 2-mercaptoethylamine, 150 grams of toluene and 50 grams of tetrahydrofuran was heated to 75° C. with agitation under a blanket of nitrogen, 2.0 grams of A.I.B.N. was added and the mixture was reacted for a period of 8 hours. The reaction mixture was then cooled to 20° C. in a water bath, 23 grams of methacrylic acid anhydride was added dropwise such that the temperature did not exceed 25° C. and the mixture was subsequently agitated for a period of 1 hour under the same conditions. Next, 0.5 gram of 2,2'-methylenebis(6-tert-butyl-p-cresol) was added and the mixture was agitated at 40° C. for a period of 3 hours. After cooling, the liquid was reprecipitated in 2 liters of methanol and 83 grams of a sticky material was obtained. The number average molecular weight was 2,200.

SYNTHESIS EXAMPLE 32

PREPARATION OF MACROMONOMER

Preparation of Macromonomer M-8

A liquid mixture of 95 grams of methyl methacrylate and 200 grams of toluene was heated to 75° C. under a blanket of nitrogen, 5 grams of A.C.V. was added and the mixture was reacted for a period of 8 hours. Next, 15 grams of glycidyl acrylate, 1.0 gram of N,N-dimethyldodecylamine and 1.0 gram of 2,2'-methylenebis-(6-tert-butyl-p-cresol) were added and the mixture was agitated at 100° C. for a period of 15 hours. After cooling, the reaction mixture was reprecipitated in 2 liters of methanol and 83 grams of a transparent, sticky material was obtained The number average molecular weight was 3,600.

SYNTHESIS EXAMPLE 33

PREPARATION OF LATEX PARTICLES

Preparation of D-1 Latex Particles

A liquid mixture of 12 grams of Resin P-1 obtained in Synthesis Example 1, 100 grams of vinyl acetate, 1.0 gram of Macromonomer M-1 obtained in Synthesis Example 24 and 380 grams of "Isoper H" was heated to 75° C. with agitation under a blanket of nitrogen, after which 1.7 grams of A.I.B.N. was added and the mixture was reacted for a period of 6 hours. A white turbidity appeared 20 minutes after the addition of the initiator and the temperature had resin to 88° C. The temperature was then raised to 100° C. and the mixture was agitated for a period of 2 hours, after which the unreacted vinyl acetate was removed by distillation. After cooling, the reaction mixture was passed through a 200 mesh nylon cloth and the white colored dispersion so obtained formed a latex of average particle size 0.20 μm at a polymerization factor of 90%.

SYNTHESIS EXAMPLE 34

PREPARATION OF LATEX PARTICLES

Preparation of D-2 to D-11 Latex Particles

These were prepared using the same procedure as in Synthesis Example 33 except that the compounds indicated in Table 3 below were used instead of Resin P-1 for dispersion stabilization purposes and Macromonomer M-1 used in Synthesis Example 33. White dispersions with polymerization factors of 85 to 90% were obtained.

TABLE 3

| Synthesis Example Preparation of Latex Particles | Latex Particles | Resin for Dispersion Stabilization Purposes | Macromonomer | Average Particle Size of the Latex Particles (μm) |
|---|---|---|---|---|
| 34 | D-2 | P-2 | M-1 | 0.19 |
| 35 | D-3 | P-2 | M-3 | 0.22 |
| 36 | D-5 | P-2 | M-4 | 0.23 |
| 37 | D-5 | P-2 | M-5 | 0.20 |
| 38 | D-6 | P-2 | M-6 | 0.21 |
| 39 | D-7 | P-3 | M-1 | 0.18 |
| 40 | D-8 | P-4 | M-7 | 0.19 |
| 41 | D-9 | P-5 | M-8 | 0.20 |
| 42 | D-10 | P-8 | M-2 | 0.19 |
| 43 | D-11 | P-9 | M-1 | 0.20 |

SYNTHESIS EXAMPLE 44

PREPARATION OF LATEX PARTICLES

Preparation of D-12 Latex Particles

A liquid mixture of 13 grams of Resin P-2 obtained in Synthesis Example 2 for preparation of a resin for dispersion stabilization purposes, 100 grams of vinyl acetate, 5 grams of crotonic acid, 1.0 gram of Macromonomer M-1 obtained in Synthesis Example 25 for preparation of a macromonomer and 468 grams of "Isoper E" was heated to 70° C. with agitation under a blanket of nitrogen. Next, 1.3 grams of 2,2'-azobis(isovaleronitrile) (referred to hereinafter as A.I.V.N.) was added and, after reacting for a period of 6 hours, the temperature was raised to 100° C. and the mixture was agitated at this temperature for a period of 1 hour, after which the residual vinyl acetate was removed by distillation. After cooling, the mixture was passed through a 200 mesh nylon cloth and the white dispersion so obtained was a latex with a polymerization factor of 85% and an average particle size of 0.25 μm.

SYNTHESIS EXAMPLE 45

PREPARATION OF LATEX PARTICLES

Preparation of D-13 Latex Particles

A liquid mixture of 14 grams of Resin P-1 obtained in Synthesis Example 1 for preparation of a resin for dispersion stabilization purposes, 100 grams of vinyl acetate, 6.0 grams of 4-pentene, 1.5 grams of Macromonomer M-7 obtained in Synthesis Example 31 of the preparation of a macromonomer and 380 grams "Isoper G" was heated to 75° C. with agitation under a blanket of nitrogen. Next, 0.7 gram of A.I.B.N. was added and the mixture was reacted for a period of 4 hours, after which 0.5 gram of A.I.B.N. was added and the mixture was reacted for a further period of 2 hours. After cooling, the reaction mixture was passed through a 200 mesh nylon cloth and the white dispersion so obtained formed a latex of average particle size 0.26 μm.

SYNTHESIS EXAMPLE 46

PREPARATION OF LATEX PARTICLES

Preparation of D-14 Latex Particles

A liquid mixture of 14 grams of Resin P-2 obtained in Synthesis Example 2 for preparation of a resin for dispersion stabilization purposes, 85 grams of vinyl acetate, 15 grams of N-vinylpyrrolidone, 1.2 grams of Macromonomer M-1 obtained in Synthesis Example 25 for preparation of a macromonomer and 380 grams of n-decane was heated to 75° C. with agitation under a blanket of nitrogen. Next, 1.7 grams of A.I.B.N. was added and the mixture was reacted for a period of 4 hours, after which 0.5 gram of A.I.B.N. was added and the mixture was reacted for a further period of 2 hours. After cooling, the reaction mixture was passed through a 200 mesh nylon cloth and the white dispersion so obtained formed a latex of average particle size 0.23 μm.

SYNTHESIS EXAMPLE 47

PREPARATION OF LATEX PARTICLES

Preparation of D-15 Latex Particles

A liquid mixture of 18 grams of Resin P-1 obtained in Synthesis Example 1 for preparation of a resin for dispersion stabilization purposes, 100 grams of methyl methacrylate, 1.5 grams of Macromonomer M-2 obtained in Synthesis Example 26 for preparation of a macromonomer, 0.8 gram of n-dodecyl mercaptan and 470 grams of n-octane was heated to 70° C. with agitation under a blanket of nitrogen Next, 1.0 gram of A.I.V.N. was added and the mixture was reacted for a period of 2 hours. A bluish-white turbidity started to appear a few minutes after the introduction of the initiator and the temperature rose to 90° C. After cooling, the reaction mixture was passed through a 200 mesh nylon cloth and the coarse particles were removed, and the white dispersion so obtained formed a latex of average particle size about 0.27 μm.

SYNTHESIS EXAMPLE 48

PREPARATION OF LATEX PARTICLES

Comparative Example A

The procedure described in Synthesis Example 33 for the preparation of latex particles was followed except that Macromonomer M-1 was omitted. The white dispersion so obtained was a latex of average particle size 0.20 μm with a polymerization factor of 85%.

SYNTHESIS EXAMPLE 49

PREPARATION OF LATEX PARTICLES

Comparative Example B

The procedure described in Synthesis Example 33 for the preparation of latex particles was followed except that 1.0 gram of octadecyl methacrylate was used instead of Macromonomer M-1. The white dispersion so obtained was a latex of average particle size 0.22 μm with a polymerization factor of 85%.

SYNTHESIS EXAMPLE 50

PREPARATION OF LATEX PARTICLES

Comparative Example C

The procedure described in Synthesis Example 33 for the preparation of latex particles was followed except that 1 gram of the monomer of which the structure is indicated below was used instead of Macromonomer M-1. The white dispersion so obtained was a latex of average particle size 0.22 μm with a polymerization factor of 86%.

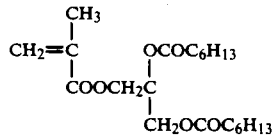

Monomer (I)

EXAMPLE 1

Ten grams of dodecyl methacrylate/acrylic acid copolymer (copolymer ratio 95/5, by weight), 10 grams of nigrosine and 30 grams of "Shellsol 71" (isoparaffin having 10 to 14 carbon atoms) were introduced together with glass beads into a paint shaker (Tokyo Seiki Co.) and a fine dispersion of nigrosine was obtained by dispersing the mixture for a period of 4 hours.

A liquid developer for electrophotographic purposes was then prepared by diluting 30 grams of Resin Dispersion D-1 from Synthesis Example 33 for preparation of latex particles, 2.5 grams of the above mentioned nigrosine dispersion, 15 grams of the higher alcohol FOC-1400 (manufactured by the Nissan Kagaku Co., alcohols having 14 carbon atoms) and 0.08 gram of an octadecyl vinyl ether/hemi-maleic acid octadecylamide copolymer with 1 liter of "Shellsol 71".

Comparative Developers A, B and C

Three types of liquid developer for comparative purposes, Liquid Developers A, B and C, were prepared by substituting the resin dispersions indicated below for the Resin Dispersion D-1 in the example of the preparation of a liquid developer described above.

Comparative Liquid Developer A: Resin dispersion of Synthesis Example 48 for preparation of latex particles.

Comparative Liquid Developer B: Resin dispersion of Synthesis Example 49 for preparation of latex particles.

Comparative Liquid Developer C: Resin dispersion of Synthesis Example 50 for preparation of latex particles.

These liquid developers were used as developers in a fully automatic plate making machine model ELP404V (made by the Fuji Film Co.) in which ELP Master type II electrophotographic photosensitive material (made by the Fuji Film Co.) was exposed and developed. The plate making process was carried out at a speed of 6 plates per minute. Moreover, toner attachment and contamination of the developing apparatus had occurred was determined after processing 2,000 ELP Master type II plates. The blackening (image area) of the copy image was carried out using an original documents having 40% of image area. The results obtained were as shown in Table 4 below.

TABLE 4

| Run Number | Invention or Comparison | Developer | Contamination of the Developing Apparatus | Image Quality of the 2000th Plate |
|---|---|---|---|---|
| 1 | Invention | Example 1 | No toner contamination | Clear |
| 2 | Comparative Example A | Developer A | XXX Pronounced toner contamination | X Text drop out, uneven blocked parts, base fogging |
| 3 | Comparative Example B | Developer B | X Toner contamination | Δ Breaks seen in fine lines Low $D_{max}$ |
| 4 | Comparative Example C | Developer C | X Toner contamination | Δ Breaks seen in fine lines Low $D_{max}$ |

When plates were using each developer under the aforementioned plate making conditions, only the developer of this invention gave rise to no contamination of the developing apparatus and produced clear images after making 2,000 plates.

On the other hand, printing was carried out in the usual way using the master plates for offset printing purposes (ELP masters) obtained by making plates with each developer. On comparing the numbers of copies printed in each case before any drop-out of text or unevenness of blocked parts, for example, occurred in the image on the printed copies, it was found that these phenomena did not occur on printing more than 10,000 copies with the master plates obtained using the developer of this invention or the developers of Comparative Examples A and C, but they did arise on printing 8,000 copies with the plate obtained using the developer of Comparative Example B.

It is clear from the results described above that only when the developer of this invention was used was it possible to obtain master plates which provided a marked increase in the number of copies which could be obtained with no contamination of the development apparatus at all.

More specifically, in the case of Comparative Example A, these was no problem with the number of copies printed but there was marked contamination of the developing apparatus and it could not be used continuously.

Furthermore, in the case of Comparative Examples B and C, the development apparatus (and especially the back of the electrode plate) became contaminated when the developers were used at a high plate making speed of 6 plates per minute (the conventional plate making speed is 2 to 3 plates per minute)and there was an effect on the image quality of the image transferred on the plate (a decrease in $D_{max}$ and breaks in fine lines) after the production of about 2,000 copies. The number of prints with the master plate was not a problem in Comparative Example C but there was a reduction in the number of prints in Comparative Example B.

These results show that the resin particles of this present invention are clearly superior.

EXAMPLE 2

A mixture of 100 grams of Resin Dispersion D-1 obtained in Synthesis Example 33 for preparation of latex particles and 1.5 grams of "Sumicron Black" was heated to 100° C. and agitated with heating for a period of 4 hours. After cooling to room temperature, the mixture was passed through a 200 mesh nylon cloth and, on removing the residual dye, a black resin dispersion of average particle size 0.20 μm was obtained.

Thirty two grams of the above mentioned black resin dispersion and 0.05 grams of zirconium naphthenate were diluted with 1 liter of "Shellsol 71" to prepare a liquid developer.

When development was carried out with this liquid developer using the same apparatus as used in Example 1 there was no toner attachment and no contamination of the apparatus at all even after developing 2,000 plates.

Furthermore, the image quality of the master plates for offset printing purposes obtained were clear and the image quality of the printed material was also very clear after printing 10,000 copies.

EXAMPLE 3

A mixture of 100 grams of Resin Dispersion D-12 obtained in Synthesis Example 17 for preparation of latex particles and 3 grams of "Victoria Blue B" was heated to 70° to 80° C. and agitated for a period of 4 hours. After cooling to room temperature, the mixture was passed through a 200 mesh nylon cloth, the residual dye was removed, and a blue colored resin dispersion of average particle size 0.25 μm was obtained.

Thirty two grams of the above mentioned blue colored resin dispersion, 10 grams of the higher alcohol FOC-1600 (made by Nissan Kagaku Co.) and 0.05 grams of zirconium naphthenate were diluted with 1 liter of "Isoper H" to prepare a liquid developer.

When development was carried out with this liquid developer using the same apparatus as used in Example 1 there was no toner attachment and no contamination of the apparatus at all even after developing 2,000 plates. Furthermore, the image quality of the master plates for offset printing purposes obtained was clear and the image quality of the printed material was also very clear after printing 10,000 copies.

EXAMPLE 4

Thirty two grams of resin Dispersion D-2 obtained in Synthesis Example 34 for preparation of latex particles, 2.5 grams of the nigrosine dispersion obtained in example 1, 0.02 gram of a hemidocosanylamido compound of a di-isobutylene/maleic anhydride copolymer and 15 grams of the higher alcohol FOC-1400 (made by Nissan Kagaku Co.) were diluted with 1 liter of "Isoper G" to prepare a liquid developer.

When development was carried out with this liquid developer using the same apparatus as used in Example 1 there was no toner attachment and no contamination of the apparatus at all even after developing 2,000 plates. Furthermore, the image quality of the master plates for offset printing purposes obtained and the image quality of the printed material after printing 10,000 copies were clear.

Moreover, processing was carried out in the same manner after leaving the developer to stand for a period of 3 months and there was no change with the passage of time.

EXAMPLE 5

Ten grams of poly(decyl methacrylate), 30 grams of "Isoper H" and 8 grams of "Alkali Blue" were introduced together with glass beads into a paint shaker and dispersed for a period of 2 hours to provide a fine dispersion of "Alkali Blue".

Thirty grams of Resin Dispersion D-11 obtained in Synthesis Example 43 for preparation of latex particles, 4.2 grams of the above mentioned "Alkali Blue" dispersion and 0.06 gram of the hemidocosanylamido compound of a diisobutylene/maleic anhydride copolymer were diluted with 1 liter of "Isoper G" to prepare a liquid developer.

When development was carried out with this liquid developer using the same apparatus as used in Example 1 there was no toner attachment and no contamination of the apparatus at all even after developing 2,000 plates. Furthermore, the image quality of the master plates for offset printing purposes obtained and the image quality of the printed material after printing 10,000 copies were very clear.

EXAMPLES 6 TO 13

Liquid developers were prepared in the same manner as in Example 1 except that Latex Particles D-3 to D-10 indicated in table 5 below were used in place of Latex Particles D-1 used in Example 1.

TABLE 5

| Example | Latex Particles |
|---|---|
| 6 | D-3 |
| 7 | D-4 |
| 8 | D-5 |
| 9 | D-6 |
| 10 | D-7 |
| 11 | D-8 |
| 12 | D-9 |
| 13 | D-10 |

No toner attachment or contamination of the apparatus was observed at all even after developing 2,000 plates when development was carried out using the same apparatus as used in Example 1. Furthermore, the image quality of the master plates for offset printing purposes obtained and the image quality of the printed material after making 10,000 copies were very clear.

Developers which have excellent dispersion stability, redispersion properties and fixing properties are obtained by means of this invention. In particular, even when the developers are used under very high speed plate making conditions there is no contamination of the developing apparatus and the image quality of the master plates for offset printing purposes obtained and the image quality of the printed material obtained after printing 10,000 copies are very clear.

While the invention has been described in detail and with reference to specific embodiments thereof, it will be apparent to one skilled in the art that various changes and modifications can be made therein without departing from the spirit and scope thereof.

What is claimed is:

1. A liquid developer for electrostatic photography comprising resin particles dispersed in a non-aqueous solvent whose electrical resistance is at least $10^9$ Ω.cm and whose dielectric constant is not more than 3.5, wherein said dispersed resin particles are copolymer resin particles obtained by polymerizing a solution which contains at least one monofunctional monomer (A) which is soluble in said non-aqueous solvent, but which is rendered insoluble by polymerization, and at least one monofunctional macromonomer (B) whose number average molecular weight is not more than $10^4$ obtained by bonding a polymerizable double bond group represented by general formula (III):

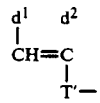

(III)

wherein T' has the same meaning as T in general formula (II) and $d^1$ and $d^2$, which may be the same or different, each has the same meaning as $b^1$ and $b^2$ in general formula (II); to only one end of the main chain or a polymer comprising repeating units represented by general formula (II):

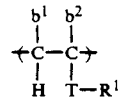

(II)

wherein T represents —COO—, —OCO—, —$CH_2$OCO—, —$CH_2$COO—, —O—, —$SO_2$—,

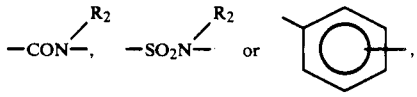

where $R_2$ represents a hydrogen atom or a hydrocarbyl group which has from 1 to 22 carbon atoms; $R_1$ represents a hydrocarbyl group which has from 1 to 22 carbon atoms; $b^1$ and $b^2$, which may be the same or different, each represents a hydrogen atom, a halogen atom, a cyano group, a hydrocarbyl group which has from 1 to 8 carbon atoms, a —COO—$R^3$ group or a —COO—$R^3$ group which is linked via a hydrocarbyl group which has from 1 to 8 carbon atoms where $R^3$ represents a hydrogen atom or a hydrocarbyl group which has from 1 to 18 carbon atoms; in the presence of a resin for dispersion stabilization purposes obtained by bonding a polymerizable double bond group which can be copolymerized with a monofunctional monomer (A) to only one end of the main chain of a polymer containing at least one repeating unit represented by general formula (I):

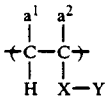

(I)

wherein X represents —COO—, —OCO—, —$CH_2$OCO—, —$CH_2$COO—, —O—, or —$SO_2$—; Y represents an aliphatic group which has from 6 to 32 carbon atoms; $a^1$ and $a^2$, which may be the same or different, each represents a hydrogen atom, a halogen atom, a cyano group, a hydrocarbyl group which has from 1 to 8 carbon atoms, a —COO—$Z^1$ group or a —COO—$Z^1$ group which is linked via a hydrocarbyl group which has from 1 to 8 carbon atoms, where $Z^1$ represents a hydrocarbyl group which has from 1 to 22 carbon atoms, wherein the amount of the repeating unit represented by general formula (I) is from 30 wt % to 100 wt % based on the resin for dispersion stabilization purposes, wherein the dispersed resin particles as toner particles are present in an amount of from 0.5 to 50 parts per 1000 parts by weight of the carrier liquid, and wherein the amount of macromonomer (B) is from 0.1 to 10 wt % with respect to monomer (A).

2. The liquid developer for electrostatic photography according to claim 1, wherein the non-aqueous solvent as a carrier liquid is a linear chain or branched chain aliphatic hydrocarbon, an alicyclic hydrocarbon, an aromatic hydrocarbon, a halogen derivative or a mixture thereof.

3. The liquid developer for electrostatic photography according to claim 1, wherein X is —COO—, —OCO—, —$CH_2$OCO—, —$CH_2$COO— or —O—, Y is an aralkyl group, an alkenyl group or an alkyl group, each having from 8 to 22 carbon atoms.

4. The liquid developer for electrostatic photography according to claim 1, wherein the weight average molecular weight of the resin for dispersion stabilization purposes is from $1\times10^4$ to $5\times10^5$.

5. The liquid developer for electrostatic photography according to claim 1, wherein the dispersed resin particles are colored dispersed resin particles.

* * * * *